US005207009A

United States Patent [19]

Thompson et al.

[11] Patent Number: 5,207,009

[45] Date of Patent: May 4, 1993

[54] METHOD AND APPARATUS FOR INCREASING DEHYDRATOR EFFICIENCY

[76] Inventors: Stanley P. Thompson, 2718 Osborn Rd., Topeka, Kans. 66614; Kenneth J. Zimmerman, 5948 SE. King Rd., Milwaukie, Oreg. 97222

[21] Appl. No.: 753,336

[22] Filed: Aug. 30, 1991

[51] Int. Cl.[5] ..... F26B 15/00; F26B 21/00

[52] U.S. Cl. ..... 34/135; 34/136; 432/108

[58] Field of Search ..... 34/135, 136, 137, 182; 432/108, 110, 111

[56] References Cited

U.S. PATENT DOCUMENTS

| | | | |
|---|---|---|---|
| 2,851,792 | 9/1958 | Steimel et al. | 34/135 X |
| 4,262,429 | 4/1981 | Avril | 432/108 X |
| 4,338,732 | 7/1982 | Coxhill | 34/135 |
| 4,742,622 | 5/1988 | Thompson | 34/135 X |
| 4,813,154 | 3/1989 | Ronning | 34/137 X |

*Primary Examiner*—Martin P. Schwadron
*Assistant Examiner*—Kevin L. Lee
*Attorney, Agent, or Firm*—Shook, Hardy & Bacon

[57] ABSTRACT

A dryer consists of a horizontal drum rotated about its horizontal axis, containing flighting around its periphery, and coupled with a heat source, all of which is well known in the prior art. The dryer is open at only one end and provides an inner tubular member, centrally mounted coaxially in the drum which member presents a preheating chamber. Material to be dried is first fed into the inner tubular member at one end of the drum and is moved through the tubular member by a plurality of curved flights thus preheating the material in preparation for drying. The material is moved through the preheating chamber to the opposite closed end of the drum where it is deposited into the primary drying chamber of the drum. Flighting in the drum moves the material back toward the inlet end of the drum as it continues to be heated and dried and is then passed into a hopper where it is moved by a conveyor. A hot gas stream, which flows counter-current to the first direction of travel of the material being dried, is directed to the open end that presents both the inlet and the outlet, from the opposite end. An alternative embodiment of the invention provides a plurality of inner tubular members, each of which is provided with a plurality of internal curved flights. The material to be dried is passed through a first tubular member and into an adjacent tubular member by means of scoops such as described above.

11 Claims, 3 Drawing Sheets

METHOD AND APPARATUS FOR INCREASING DEHYDRATOR EFFICIENCY

This invention relates generally to bulk solids drying equipment and, more particularly, to a horizontal dryer for solid material which employs a preheating device to increase dryer efficiency.

Bulk solids dryers are well known in the art and generally consist of a horizontal drum which is rotated about its horizontal axis and is coupled with a heat source for drying the material which is loaded into the drum. Horizontal dryers of this type are normally open at both ends and material is fed from one end to the other with the heat source being coupled with the drum near the inlet. It is also well known to provide flighting around the periphery of the drum and mounted in the interior of the drum for distributing the solid material over the widest possible area to facilitate the drying process. Counter-flow dryers, where gases enter one end, travel the length of the drum, reverse course and exit from the same end they entered, are also known.

The present invention represents a departure from the prior art by utilizing a horizontal drum which utilizes one end to provide both an inlet and an outlet for material going to and from the drum. This material is passed in counter-current flow. The drying gas moves in one direction only which is concurrent to the direction of material flow for half the traveled distance and counter-current for the other half. A novel central passageway through the drum is provided by a tubular member and material entering the drum is first fed through this tubular member where it is passed to the opposite end of the drum before moving back to the entry point. The resulting dryer is more efficient, can dry material in a shorter amount of time, will generate less pollution and can actually be reduced in length (or have increased capacity) in comparison with prior art dryers because of greater efficiency.

It is therefore a primary object of the present invention to provide a dryer for bulk solids and method of drying which incorporates a predrying chamber through the center of the dryer which prepares the material for drying thus making the dryer more efficient and reducing the overall required length of the dryer.

Another one of the objectives of our invention is to provide a horizontal dryer for bulk solids and method of drying which is particularly useful in drying wood wafers and the like where there is a need to dry the material relatively quickly so as to avoid damage to it and this is accomplished by utilizing a novel preheating chamber in a horizontal drying drum.

It is also an important aim of our invention to provide a horizontal dryer and drying method for bulk solids which, by virtue of a novel segregated preheating zone, allows the dryer to receive and discharge material at only one end thus reducing heat loss and also permitting the overall length of the dryer to be reduced in comparison to prior art dryers.

Another one of the objectives of this invention is to provide a horizontal dryer for bulk solids which incorporates a segregated preheating zone, the temperature of which can be controlled through the use of a mixture of recycled gases and outside air.

Another one of the objectives of this invention is to be able to receive material from at one point in the conveying system, perform the drying operation and return the material to the same point in the conveying system.

Other objects of the invention will be made clear or become apparent from the following description and drawings wherein.

Figure 1:
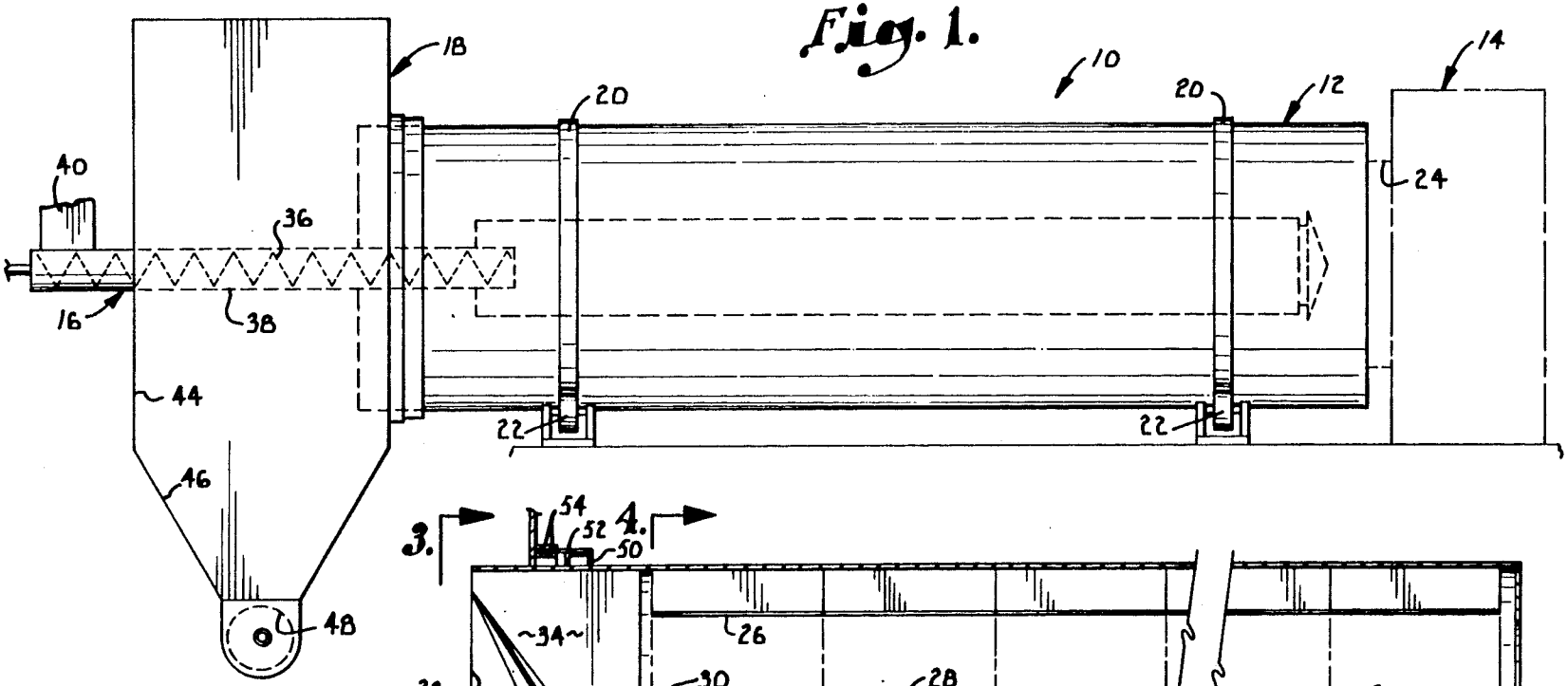
FIG. 1 is a side elevational view of a bulk solids dryer according to the present invention.

Referring initially to FIG. 1, the dryer for bulk solids according to the present invention is designated generally by the numeral 10 and includes an elongated, cylindrical, horizontally disposed drying drum 12, a heater 14, inlet feed mechanism 16 and an outlet delivery apparatus 18.

Figure 2:
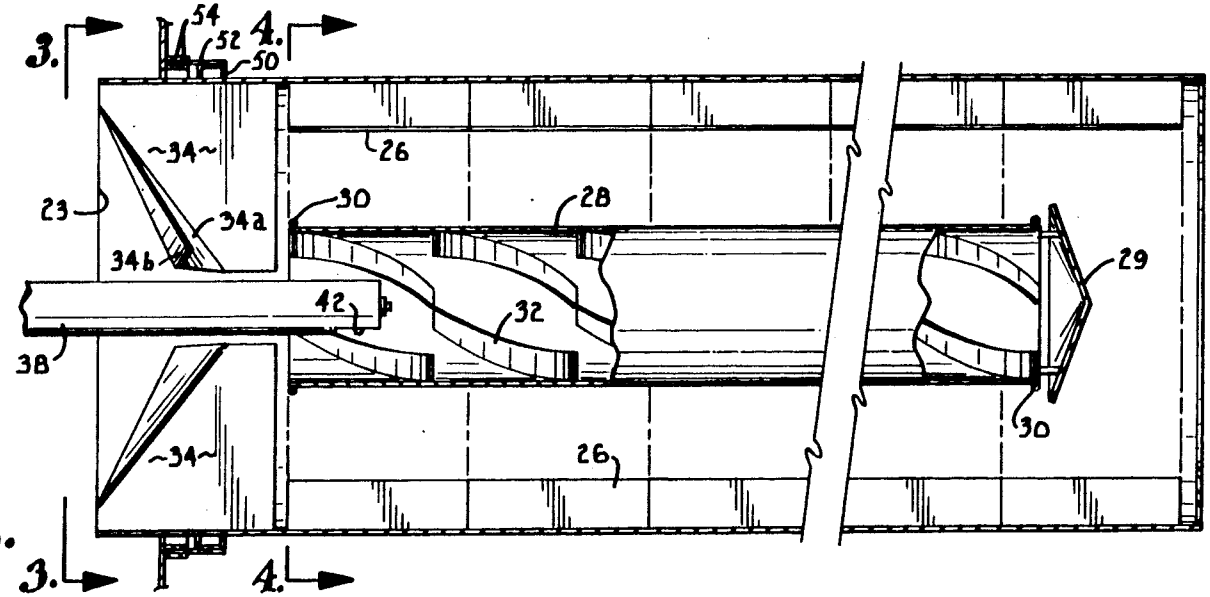
FIG. 2 is an enlarged vertical cross-sectional view with portions broken away and shown in cross-section of the novel dryer of FIG. 1.

Referring now to FIGS. 1 and 2, drying drum 12 is provided with circumscribing track members 20 which mount the drum on rollers 22 for rotation about its horizontal axis. An appropriate prime mover such as an electric motor (not shown) is coupled with drum 12 for effecting its rotation. A plenum chamber 24 couples drum 12 with heater 14 so as to transfer heat via a stream of hot gases to the interior of the drum. It is to be understood that heater 14 may include a forced air fan (not shown) for directing heated gases (primarily air) through the plenum chamber and into the interior of the drum.

The internal surface of drum 12 is characterized by a plurality of flights 26 mounted thereon in circumferentially spaced relationship and extending over substantially the entire length of the drum. While only two rows of flighting 26 are illustrated in FIG. 2, it is to be understood that many more rows would be present circumferentially spaced around the diameter of the drum. This flighting is well known in the art and is shown only schematically in FIG. 2. An elongated, tubular member 28, which is preferably of a diameter no more than about one-tenth to one-third the diameter of drum 12, is centrally mounted in the drum, coaxially with the latter, by hanger brackets 30. Mounted on the interior surface of tubular member 28 is a plurality of curved flights 32 which direct material entering the tubular member from left to right in FIG. 2 upon rotation of the drum. It is to be noted that tubular member 28 is open at both ends and one end is spaced from material inlet end 23 of the drum while the other end is spaced away from that end of drum 12 which is coupled with heater 14. The end nearest heater 15 is provided with a deflector 29 which allows for material to egress from the end of the tubular member while deflecting hot gases away from the tube interior. Tubular member 28 thus presents a preheating chamber which is segregated from the rest of the drum interior. That portion of the drum interior outside of tubular member 28 presents the primary drying chamber.

Mounted immediately adjacent drum end 23 is a plurality of scoops 34 which are arranged in circumferentially spaced relationship, each including an inclined surface 34*a* which extends at an angle of 40–80°, preferably about 60°, relative to an imaginary vertical plane passing through the drum. Each scoop 34 also includes a retaining lip 34*b* which is generally perpendicular to surface 34*a*.

Figure 4:
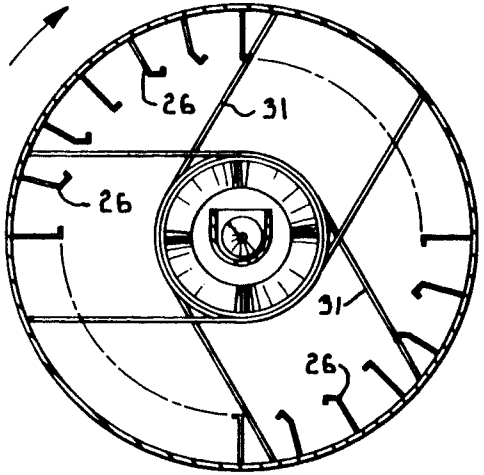
FIG. 4 is a vertical cross-sectional view taken along line 4—4 of FIG. 2.
Figure 3:
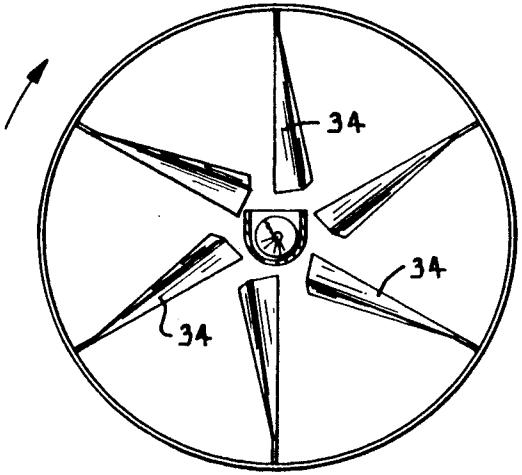
FIG. 3 is a vertical cross-sectional view taken along line 3—3 of FIG. 2.

Material to be dried is fed into dryer 10 by the inlet feed mechanism 16 which includes a screw auger 36, an auger housing 38 and an inlet chute 40 which extends upwardly from housing 38. As can be seen from viewing FIG. 4, housing 38 and auger 36 extend through open drum end 23 into tubular member 28 where an opening 42 in the housing allows material to be fed into the tubular member.

Outlet delivery apparatus 18 includes a housing 44 which surrounds open drum end 23 and merges into hopper 46 which in turn feeds a conveyor 48. A U-shaped channel 50 on the outside of drum 12 cooperates with a flat piece of flexible material such as rubber or plastic 52 which is mounted on housing 44 by bracket sections 54 to form a flexible seal between the housing and the rotating drum 12.

When the dryer 10 is to be used for drying bulk solids, heater 14 is actuated to provide the necessary heating in the drum which is rotated on rollers 22 about its horizontal axis. The material to be dried is fed into the drum through chute 40 and housing 38 by auger 36. Manifestly, the outlet for housing 38 is just inside of the open end of the central chamber presented by tubular member 28. As the material is deposited in tubular member 28, it is moved to the opposite end of the central chamber by flights 32. As the material is moved along the central chamber, it is preheated and its temperature raised to a level such that actual drying can commence once it enters the primary chamber of the drying drum. This is accomplished by the stream of hot gases flowing in a counter-current direction from the far end of the drum toward the inlet end. It is to be understood that the temperature within the tubular member 28 can be controlled by directing recycled gases or outside air or a mixture of same to the preheating chamber. The actual operating parameters will vary depending upon the material being dried, the moisture content and the atmospheric conditions.

The material from the preheating chamber passes out through the opening between the deflector 29 and the tube end 30 and is deposited into the primary drying chamber of the drum. Flighting 26 will then distribute the material around the periphery of the drum and move it back in the direction of end 23 which also serves as the material exit end. Heating, of course, continues during this movement of the material in a direction which is counter-current to the direction of the material entering the drum through the preheating chamber and concurrent with the flow of hot air passing from heater 14 to the inlet/outlet end of the drum. As the material nears the drum end 23, its path of travel is partially interrupted by scoops 34 which stop movement of some of the material toward the open end and direct it back to the inlet end of the preheating chamber where it is recycled. Some of the material continually goes past the scoops 34 and enters hopper 46 where it is moved to another location by conveyor 48.

Figure 5:
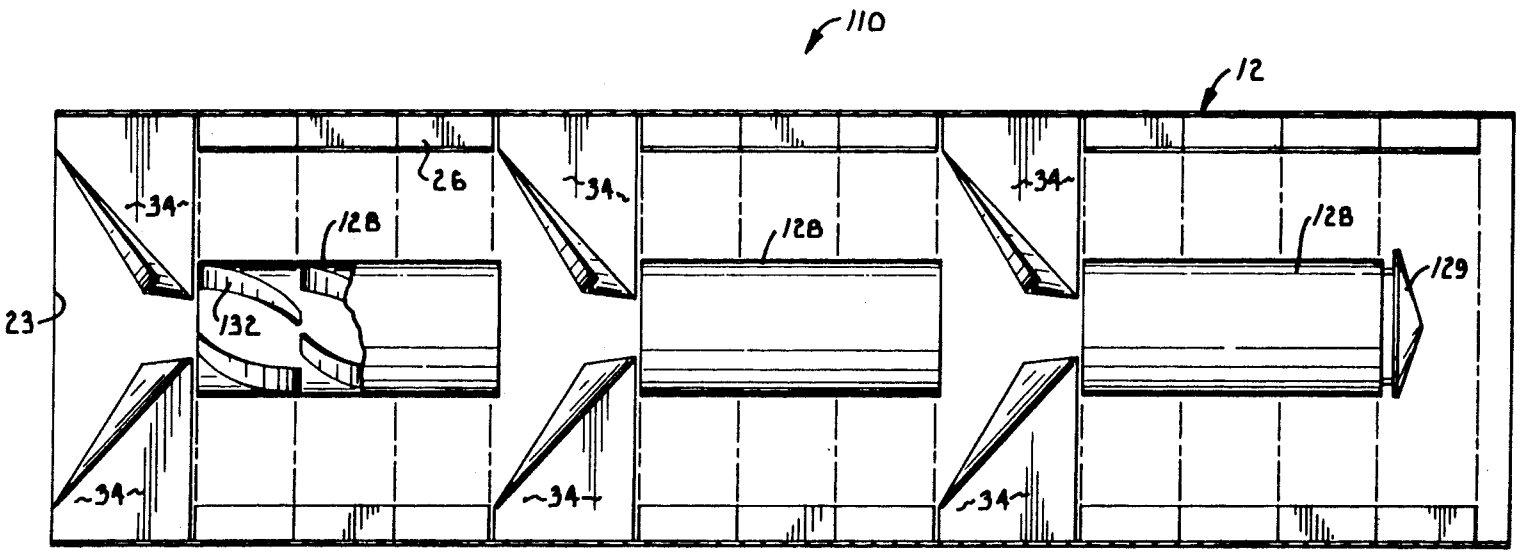
FIG. 5 is a vertical cross-sectional view with portions broken away and shown in cross-section illustrating an alternative embodiment of the novel horizontal drying drum according to the present invention.

An alternative embodiment of the invention is shown in FIG. 5 and designated generally by the numeral 110. In the embodiment 110, drum 12 is again provided with internal flighting 26 and has an end 23 for receiving and discharging material, the other end being coupled with a heater 14 (not shown). The alternative embodiment is identical in construction to the preferred embodiment described above except in the respects specifically noted hereinafter.

Rather than a singular elongated tubular member 28 as in the preferred embodiment discussed above, a plurality of elongated tubular members 128 are mounted along the length of drum 12 in axially aligned and horizontally spaced apart relationship. It is to be understood that each tubular member 128 will be held in place by hanger brackets 31 (FIG.4), although these brackets have not been shown in FIG. 5 in the interest of brevity and clarity. Each tubular member 128 is substantially identical and is provided with a plurality of internal curved flights 132. Each tubular member 128 defines an axial preheating chamber which presents an internal passageway through the drum. Flights 132 are arranged so that, upon rotation of the drum, material deposited in the preheating chamber will be advanced along the length of the drum toward the end which is opposite end 23. In this regard, it is to be understood that an inlet feed mechanism such as 16 would extend into the first chamber presented by a tubular member 128 in a manner substantially similar to that shown for the preferred embodiment.

Each tubular member 128 is spaced from a adjacent tubular member a sufficient distance so as to allow the placement of two or more scoops 34 between the two adjacent tubular members. Scoops 34 are also placed at the end 23 in the same arrangement as described for the preferred embodiment above. The tubular member opposite open end 23 has a deflector 129 for keeping hot gases out of the tube interior while allowing solid material to egress.

Material is fed to the first tubular member 128 and is then advanced longitudinally in the drum away from end 23 until the material exits a tubular member 28 and is deposited in the primary drying chamber of drum 12 and is distributed by the rotating drum. Some of the material will be picked up by scoops 34 and fed into the next adjacent tubular member 128 where the material again advances away from end 23 until it reaches the end of the second preheating chamber where it is deposited back into the primary heating chamber of the drum. The next set of scoops 134 picks up a portion of the material and deposits it in the next adjacent preheating chamber presented by the third tubular member 128. The material emanating from the end of the third tubular member is directed downwardly by deflector 129 and will gravitate into the primary heating chamber of the rotating drum and be distributed circumferentially while being moved back toward end 23.

The alternative embodiment of the invention will find utilization with certain types of material where the need for preheating prior to the full drying action of the dryer is less and the material can thus be deposited into the primary drying chamber of the dryer quicker. Also, the chambers presented by members 128, while still to some extent segregated from the rest of the drum interior, will have a temperature which is closer to that of the primary drying chamber. Thus, the differential between the primary drying chamber of drum 12 and the preheating chambers presented by the members 128 will be less than with the preferred embodiment.

Figure 6:
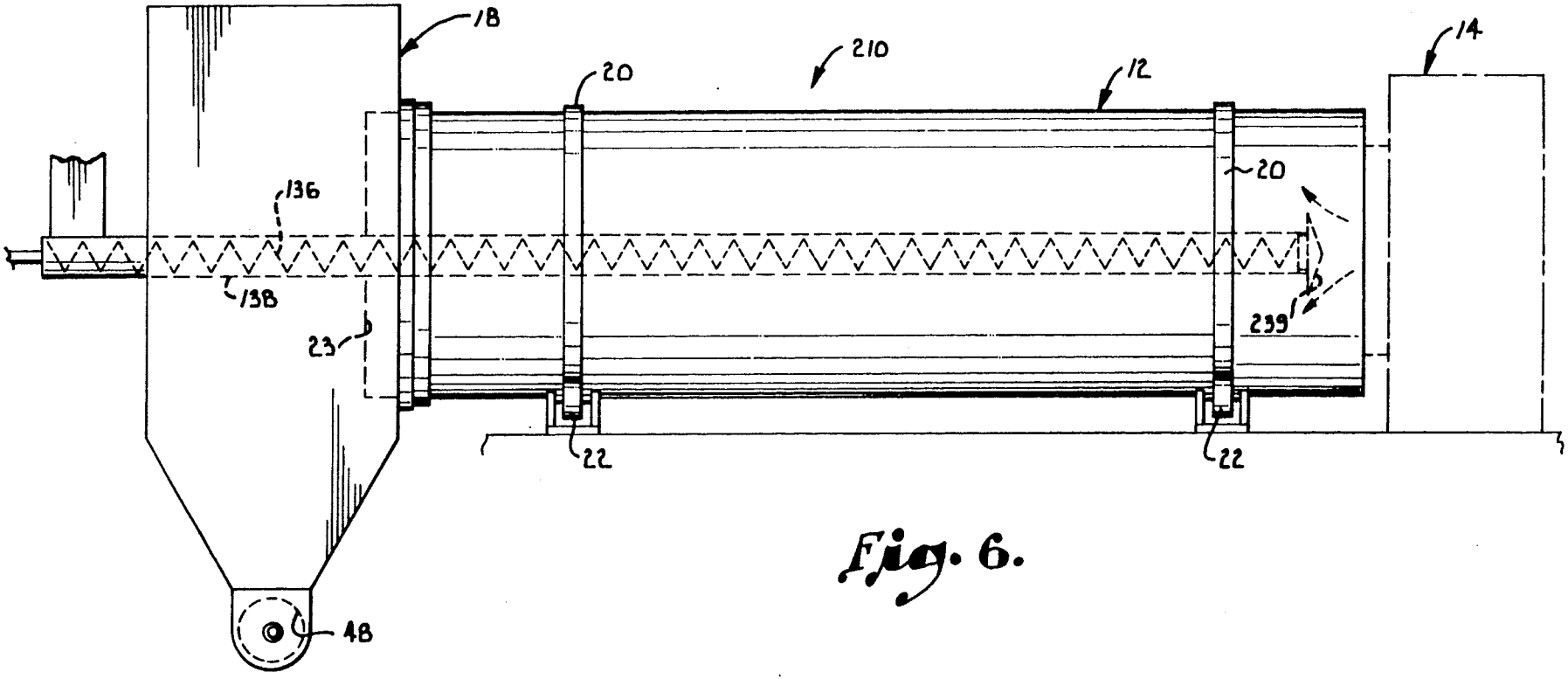
FIG. 6 is a side elevational view of an alternative embodiment of a bulk solids dryer according to the present invention.

Referring now to FIG. 6 of the drawings, another alternative embodiment is designated generally by the numeral 210. In this embodiment like reference numerals have been used to indicate components that are identical to corresponding components of the preferred embodiment described above. In the embodiment 210 an auger 136 extends from outside of delivery apparatus 18 through the interior of drum 12 to a point adjacent the heater 14. Auger 136 is enclosed within tubular housing member 138 which extends substantially the length of the drying drum and is provided with a deflector 239 at the outlet end of the housing member.

In operation, material to be dried is fed to the drying drum by auger 136 which, in cooperation with the tubular housing member 138 provides means for conveying the material through the passageway presented by the housing. The material is moved in a direction opposite to the direction of the open drum end 23 where it egresses from the housing member 138 and is deflected downwardly by deflector 239. Thus, the material to be dried is preheated in the same manner as described for the preferred embodiment as it moves through the tubular housing and the material reaches a temperature as it egresses from the tubular member so that actual drying can commence as it enters the primary chamber of the drying drum. As with the preferred embodiment, the temperature within the tubular housing 138 can be controlled by directing recycled gases or outside air to the housing chamber. Thus, operation of this alternative embodiment is substantially similar to the preferred embodiment previously described except for the mean of moving the material through the preheating chamber which in this case takes the form of auger 136.

From the foregoing description, it will be apparent that the invention encompasses a method of drying bulk solids in an elongated cylindrical drying drum which is disposed for rotation about its horizontal axis. The method is carried out in a preheating chamber and in the primary drying chamber of the drying drum which extends longitudinally of the drum. The method comprises introducing the material to be dried into the preheating chamber at one end of the drum, moving the material through the chamber to a point spaced from the said one end while heating the material by a stream of hot gases that moves in counter-current relation to the incoming material until the latter reaches for the end of the drum, then depositing the material from the chamber into the primary drying chamber, and finally moving the material through the drum back to the end where the material was first introduced while simultaneously heating the material with the hot gas stream which moves in concurrent relationship to the material that is deposited in the primary drying chamber to accomplish drying of it. It is also contemplated that the temperature in the preheating chamber may be controlled while the material is being moved therethrough.

Although the reasons are not fully understood, it is believed that the apparatus and method of the invention results in a drying operation which produces fewer air pollutants than with conventional dryers.

Having thus described the invention, we claim:

1. Apparatus for drying a solid material, said apparatus comprising:

an elongated generally cylindrical drum disposed in a generally horizontal direction, said drum having at least one open end presenting a material inlet and flighting located internally of said drum for directing material in the drum toward said open end;

an elongated open ended tubular member mounted internally of said drum and extending at least part way along the length thereof, said tubular member presenting a material passageway through said drum;

means cooperative with said tubular member for conveying material through said passageway in a direction away from said material inlet and depositing said material into the open drum;

means coupled with the interior surface of said drum for moving the material deposited from said tubular member toward said open end; and means for raising the temperature in said drum to substantially remove all of the water from said material.

2. Apparatus as set forth in claim 1, wherein said open drum end also presents an outlet for said material.

3. Apparatus as set forth in claim 2, wherein said means for conveying material through said tubular member comprises flighting mounted on the interior of said member.

4. Apparatus as set forth in claim 3, wherein said tubular member extends substantially the length of said drum.

5. Apparatus as set forth in claim 4, wherein is included means on said drum for directing a portion of the material which would otherwise pass out through said open drum end back through said tubular member.

6. Apparatus as set forth in claim 3, wherein is included a plurality of said tubular members disposed in spaced apart relationship and axial alignment along the length of said drum, and means disposed between each two aligned tubular members for directing material passing through said drum in the direction of said open drum end into said tubular members.

7. Apparatus as set forth in claim 2, wherein is included conveyor means extending from outside said drum to a point inside of said tubular member for feeding material to be dried into the drum.

8. Apparatus as set forth in claim 2, wherein is included means for rotating said drum about its horizontal axis.

9. Apparatus as set forth in claim 7, wherein is included mean for supplying heat to said drum for drying said material.

10. Apparatus as set forth in claim 1, within said means for conveying material through said tubular member comprises screw conveyor means extending from outside said drum through substantially the entire length of said member.

11. Apparatus as set forth in claim 1, wherein means for raising the temperature comprise means for directing a stream of hot gases toward said open end of said drum from the opposite drum end.

* * * * *